US006220484B1

(12) United States Patent
Martindale

(10) Patent No.: US 6,220,484 B1
(45) Date of Patent: Apr. 24, 2001

(54) DISPENSING SPOUT-TO-BOTTLE SECURITY STRAP

(75) Inventor: Richard A. Martindale, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 09/417,379

(22) Filed: Oct. 13, 1999

(51) Int. Cl.[7] ..... B67D 3/00

(52) U.S. Cl. ..... 222/153.06; 222/153.14; 222/481.5; 222/525; 215/901

(58) Field of Search ..... 222/153.05, 153.06, 222/153.14, 481.5, 523, 525; 215/901

(56) References Cited

U.S. PATENT DOCUMENTS 3,117,701 * 1/1964 Stull ..... 222/153.14
5,472,120 * 12/1995 Stebick et al. ..... 222/523
5,996,849 * 12/1999 Bansal ..... 222/153.14
6,079,589 * 6/2000 Matsuyama et al. ..... 222/525

* cited by examiner

*Primary Examiner*—Joseph A. Kaufman
(74) *Attorney, Agent, or Firm*—Townsend and Townsend and Crew LLP

(57) ABSTRACT

A beverage dispensing device includes a dispensing spout disposed at the mouth of a bottle. A single-piece, disposable security strap is used to secure the spout to the bottle to prevent unauthorized removal of the spout to dispense drinks. The spout has a distal portion with a spout opening and a proximal shoulder larger in cross-sectional than the distal portion. The security strap includes a strap ring having an opening configured to surround and capture the proximal shoulder of the spout. The strap further includes at least a pair of connecting portions extending from the strap ring. Each connecting portion has an affixing member at an end. At least one of the affixing members has a self-adhering surface for adhering to the exterior of the bottle. To dispense the beverage, the strap is broken and discarded.

20 Claims, 4 Drawing Sheets

DISPENSING SPOUT-TO-BOTTLE SECURITY STRAP

BACKGROUND OF THE INVENTION

This invention relates generally to dispensing apparatus, and more particularly to a security strap for a bottle spout for dispensing a beverage.

Beverages such as liquor are typically poured from a bottle into a glass in which a drink is being mixed. A spout is often attached to the mouth of the bottle to dispense the liquor at a relatively constant flow rate so that a bartender can free-pour the liquor without the need for a measuring device, such as a jigger. A need exists for a simple, inexpensive way of securing the spout to the bottle to prevent unauthorized removal of the spout to dispense drinks.

SUMMARY OF THE INVENTION

The present invention provides a single-piece, disposable security strap that is inexpensive to manufacture, and easy to use effectively to prevent unauthorized use.

In accordance with an aspect of the present invention, a security strap for a beverage dispensing device having a bottle and a spout disposed at the mouth of the bottle includes a strap ring having an opening configured to surround a portion of the spout. First and second connecting portions extend from the strap ring. A first affixing member is connected to the end of the first connecting portion. A second affixing member is connected to the end of the second connecting portion. The first and second affixing members include an adhesive for securing the affixing members to the exterior of the bottle.

In some embodiments, at least one of the first and second affixing members includes a self-adhering surface. The first and second connecting portions are generally straight strips extending generally radially outwardly from the strap ring. The opening of the strap ring is sufficiently large to allow a distal portion of the spout to pass therethrough and is sufficiently small to surround and engage a proximal shoulder of the spout. The strap ring is generally circular. In a specific embodiment, the security strap includes a third connecting portion extending from the strap ring and a third affixing member connected to the end of the third connecting portion. In a preferred embodiment, the first and second affixing members are configured to be connected together to form an affixing loop around the exterior of the bottle.

Another aspect of the invention is directed to a security strap for a beverage dispensing device having a bottle and a spout disposed at the mouth of the bottle. The security strap includes a strap band having an opening configured to capture a portion of the spout and a plurality of connecting portions extending from the strap band. Each connecting portion includes an affixing member at an end thereof. The affixing members are configured to be connected together to form a fastening band around the exterior of the bottle. The security strap may have a generally uniform thickness.

Another aspect of the invention is a method of securing a spout disposed at a mouth of a bottle to the bottle using a security strap which includes a strap ring having an opening configured to capture a portion of the spout, and a plurality of connecting portions extending from the strap ring, each connecting portion having an affixing member at an end thereof. The method includes placing the strap ring around the spout to capture a portion of the spout with the opening, and adhering the affixing members to the exterior of the bottle to secure the strap ring around the spout against the mouth of the bottle to prevent displacement of the spout for dispensing.

In some embodiments, each affixing member is adhered to the exterior of the bottle. A self-adhesive surface is provided on at least one of the affixing members. The affixing members are connected together to form an affixing loop surrounding the bottle. An adhesive is applied between at least one of the affixing members and the exterior of the bottle. The security strap is provided with at least one self-adhering surface releasably adhered to a strap. The security strap is peeled from the strip for use. In a specific embodiment, the opening of the strap ring is larger than a distal portion of the spout and smaller than a proximal shoulder of the spout. The strap ring is placed around the proximal shoulder of the spout by passing the distal portion therethrough.

DESCRIPTION OF THE SPECIFIC EMBODIMENTS

Figure 1:
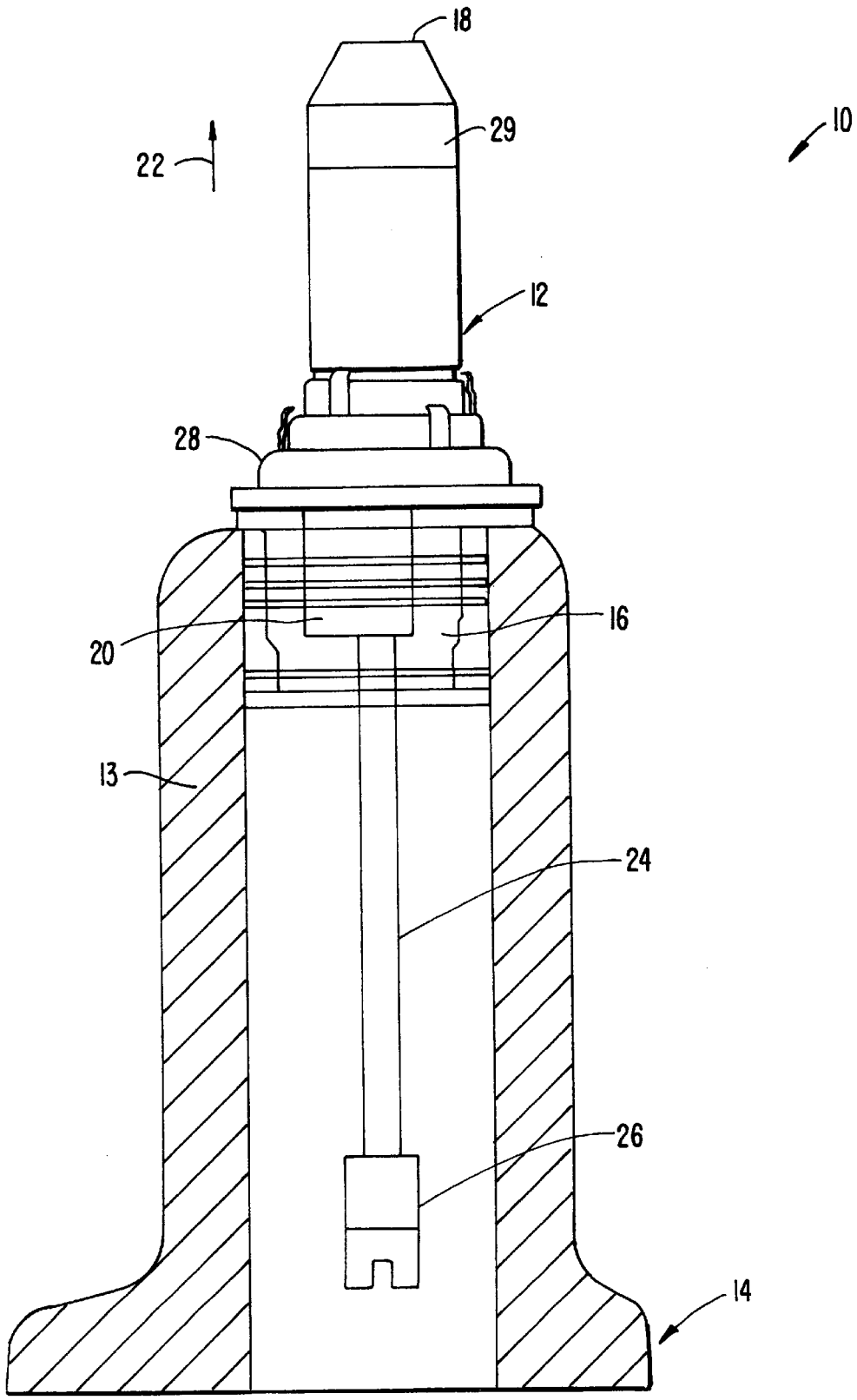
FIG. 1 is a partial cross-sectional view of a dispensing apparatus having a spout inserted into the neck of a bottle.

FIG. 1 shows a typical dispensing apparatus 10 having a spout 12 inserted into the mouth at the neck 13 of a bottle 14. The spout 12 has a spout seal 16, which typically is a plastic, tubular liner making a liquid-tight junction between the spout 12 and the inner surface of the bottle neck 13. The spout seal 16 has outwardly extending flanges which sealingly engage the inner surface of the bottle neck 13. The spout 12 includes a flow passage extending from inside the bottle neck 13 to a spout opening 18. A valve mechanism 20 is disposed along the flow passage to allow control of the flow of beverage from the bottle therethrough. In a specific embodiment, the valve in the valve mechanism 20 is closed when the spout 12 is pushed against the mouth of the bottle neck 13, and is opened by pulling the spout 12 outward in the direction indicated by arrow 22.

The spout 12 typically includes a breather tube 24 extending into the interior of the bottle 14. The remote end of the breather tube 24 has a check valve assembly 26 which prevents the beverage from escaping through the breather tube 24 when the bottle 14 is inverted but the spout valve in the valve mechanism 20 is not yet open. When the spout valve is open, the breather tube 24 and check valve 26 permit air to enter the bottle 14 to replace the volume of the beverage which flows from the bottle 14 out of the spout opening 18. The spout 12 includes a proximal shoulder 28 which is larger in cross-section than the distal head 29 having the spout opening 18 at the distal end thereof.

Figure 2:
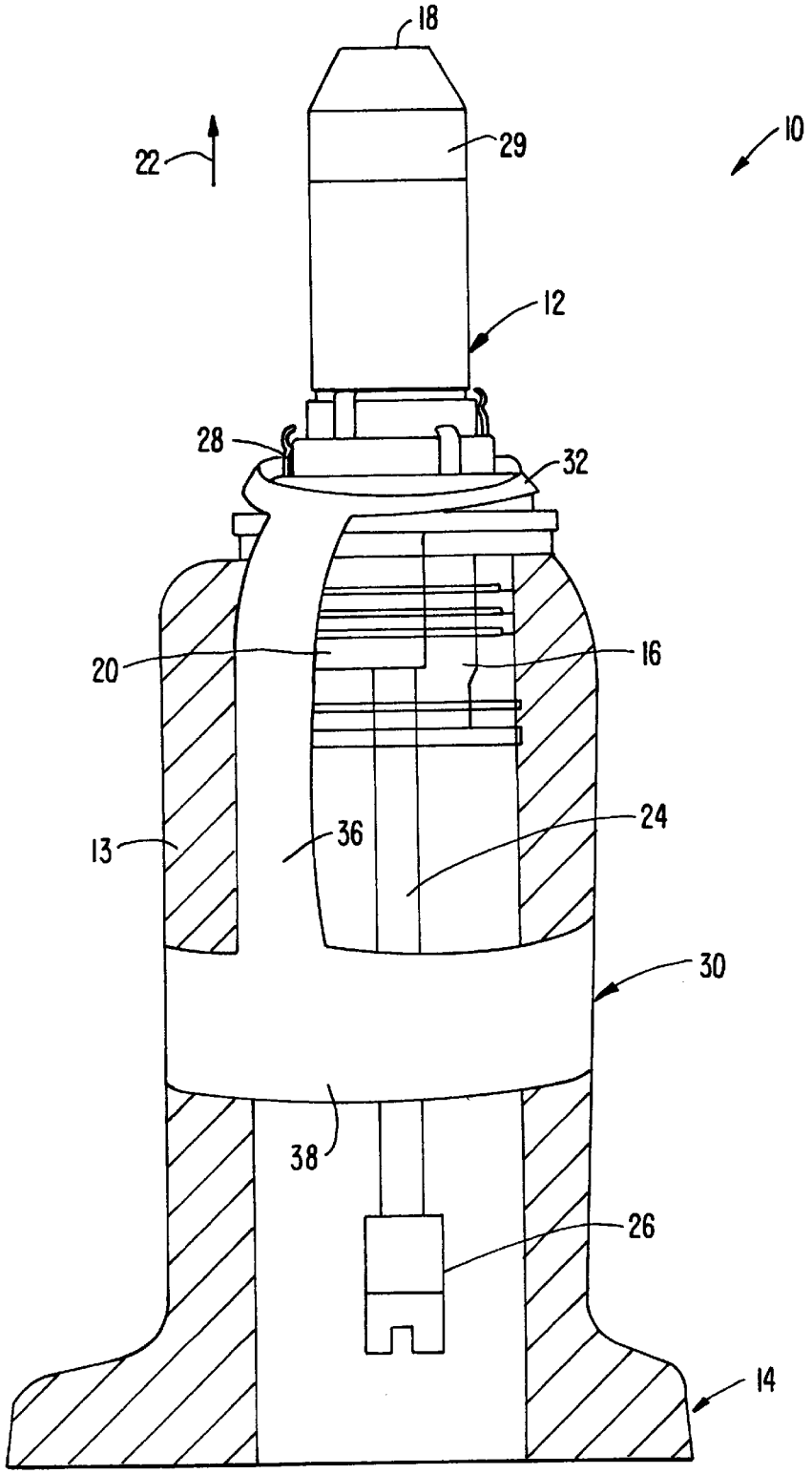
FIG. 2 is a partial cross-sectional view of the dispensing apparatus of FIG. 1 with a spout-to-bottle security strap securing the spout to the bottle according to an embodiment of the present invention.
Figure 3:
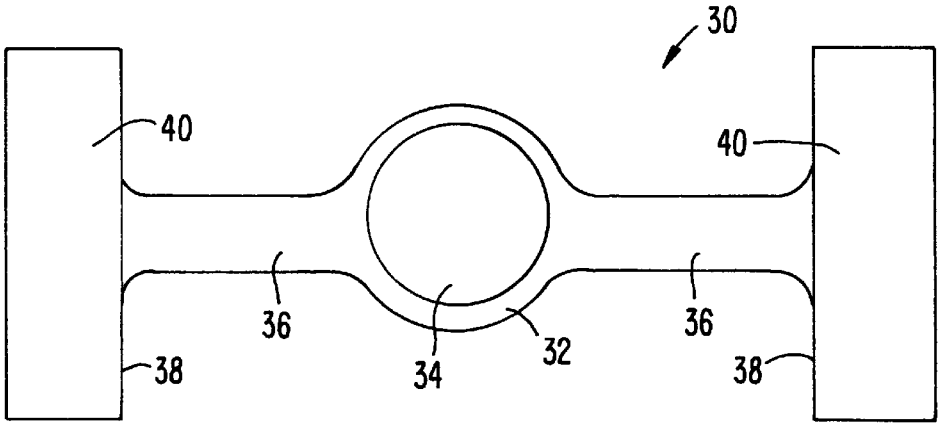
FIG. 3 is a plan view of the security strap of FIG. 2.

FIG. 2 shows a security strap 30 securing the spout 12 to the bottle neck 13. The security strap 30 includes a strap band 32 surrounding a portion of the spout 12. As best seen in FIG. 3, the strap band is an annular ring 32 having a strap opening 34 which is typically circular but may have other shapes. The strap opening 34 is large enough to allow the distal head 29 of the spout 12 to pass therethrough, but is sufficiently small to capture the proximal shoulder 28 of the spout 12, as shown in FIG. 2. A pair of connecting portions 36 extend from the strap ring 32 to a pair of affixing members 38, respectively. The connecting portions 36 are straight strips that are narrow in width, and extend from the strap ring 32 radially outwardly in generally opposite directions. The connecting portions 36 preferably are substantially smaller in width than the strap ring 32, the width of which is its outer diameter in the embodiment shown. The affixing members 38 are generally rectangular in shape, and desirably include self-adhering surfaces 40 for adhering to the outside of the bottle neck 13. The self-adhering surfaces 40 may contain, for example, a self-sticking adhesive. Alternatively, an adhesive may be applied to the affixing members 38 to secure them to the bottle neck 13.

Figure 4:
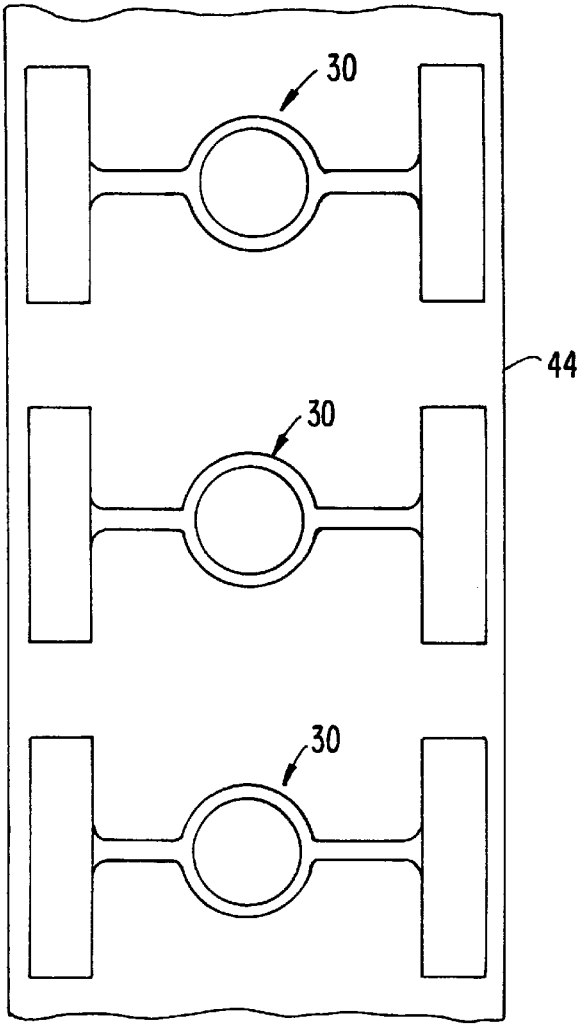
FIG. 4 is a plan view showing a row of security straps of FIG. 3.

The security strap 30 may be made of a variety of materials, including plastics and the like. The single-piece strap 30 is preferably thin and can be mass-produced easily and inexpensively by molding, die-cutting, or the like. The thickness of the strap 30 desirably is generally uniform, and is typically less than about 0.06 inch, and preferably about 0.002–0.012 inch. In a preferred embodiment, the straps 30 are manufactured in a row and provided on a strip 44 as shown in FIG. 4. The strip 44 has a suitable surface such that the self-adhering surfaces 40 of the strap 30 are releasably adhered to the strip 44. The straps 30 can be peeled off individually as needed.

In use, a security strap 30 is peeled off from the strip 44 of FIG. 4 and placed over the spout 12 to capture the proximal shoulder 28 with the strap ring 32, as shown in FIG. 2. The affixing members 38 are pulled as far down the bottle neck 13 as possible, and are then fastened to the exterior of the bottle neck 13 to form a fastening band or affixing loop surrounding the neck 13. In this position, the spout 12 is securely strapped to the bottle neck 13 to prevent dispensing beverage from the bottle 14. To dispense the beverage, the strap 30 is removed, typically by breaking the connecting portions 36 or separating the seal between the affixing members 38 and the exterior of the bottle neck 13. The strap 30 is removed and discarded, and the spout 12 is freed to allow beverage dispensing.

Figure 5:
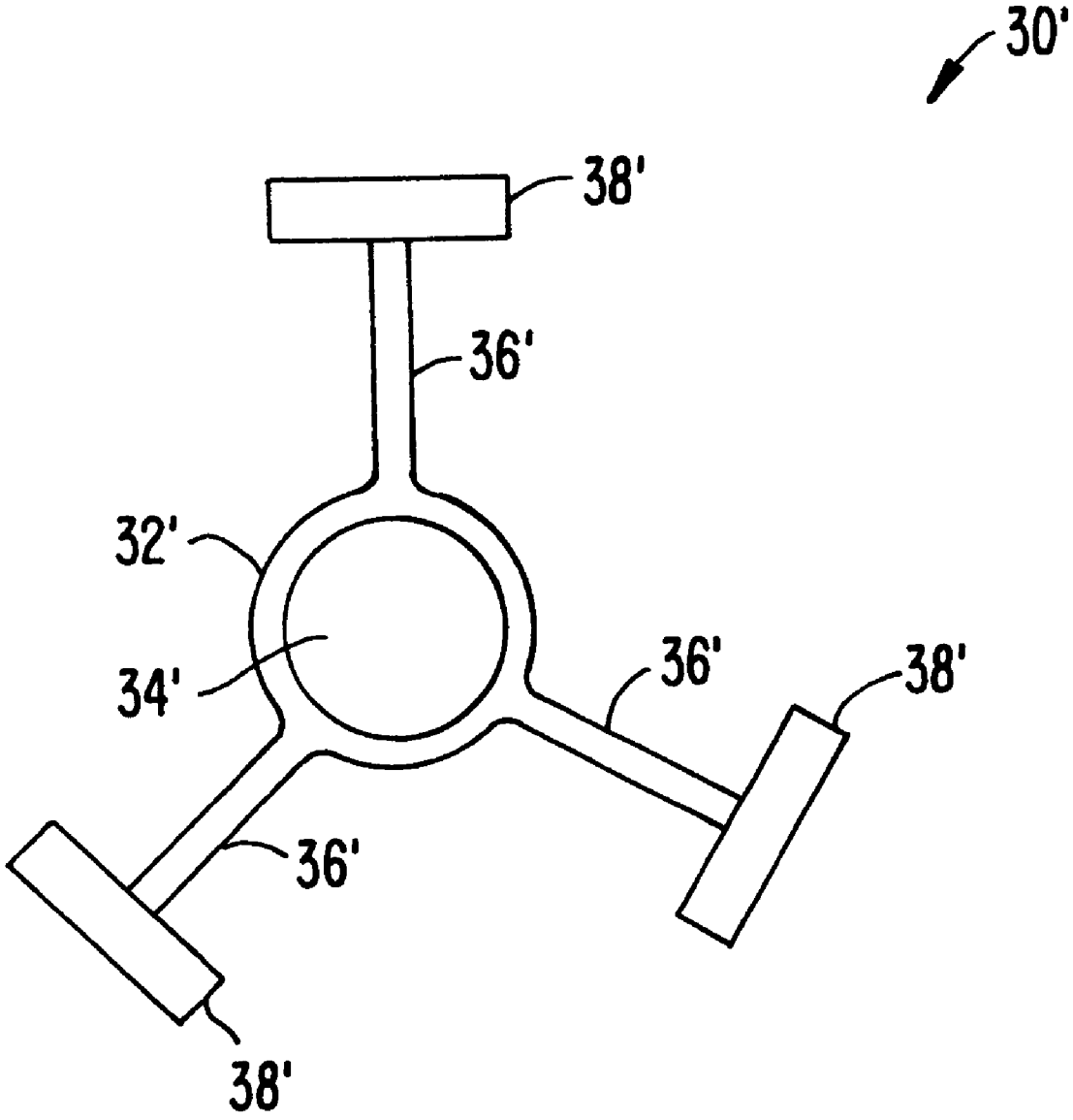
FIG. 5 is a plan view of a security strap according to another embodiment of the present invention.

The above-described arrangements of apparatus and methods are merely illustrative of applications of the principles of this invention and many other embodiments and modifications may be made without departing from the spirit and scope of the invention as defined in the claims. For instance, the connecting portions 36 of the strap 30 may extend from the strap ring 32 in directions that are not opposite. The connecting portions 36 need not be straight. The strap 30 may include more than two connecting portions 36 and affixing members 38. FIG. 5 shows a strap 30' having three connecting portions 36' and three affixing members 38'. The affixing members 38 may have other shapes. The spout may be replaced by a cap or another closure member. In an alternate embodiment, the affixing members 38 do not extend around the bottle neck 13 to surround the neck 13. In another alternative embodiment, only one of the affixing members 38 contains an adhesive which allows it to adhere to the bottle neck 13 and to the other affixing member so that both affixing members 38 are secured to the bottle neck 13. The scope of the invention should, therefore, be determined not with reference to the above description, but instead should be determined with reference to the appended claims along with their fill scope of equivalents.

What is claimed is:

1. A security strap for a beverage dispensing device having a bottle and a spout disposed at the mouth of the bottle, the security strap comprising:

a strap ring having an opening configured to surround a portion of the spout;

first and second connecting portions extending from the strap ring;

a first affixing member connected to the end of the first connecting portion; and a second affixing member connected to the end of the second connecting portion, the first and second affixing members including an adhesive for securing the affixing members to the exterior of the bottle.

2. The security strap of claim 1 wherein at least one of the first and second affixing members includes a self-adhering surface.

3. The security strap of claim 1 wherein the first affixing member and second affixing member are generally rectangular.

4. The security strap of claim 1 wherein the first and second connecting portions comprise narrow strips each being substantially smaller in width than the strap ring.

5. The security strap of claim 1 wherein the first and second connecting portions comprise generally straight strips extending generally radially outwardly from the strap ring.

6. The security strap of claim 1 wherein the first and second connecting portions extend in generally opposite directions from the strap ring.

7. The security strap of claim 1 wherein the opening of the strap ring is sufficiently large to allow a distal portion of the spout to pass therethrough and is sufficiently small to surround and engage a proximal shoulder of the spout.

8. The security strap of claim 1 wherein the strap ring is generally circular.

9. The security strap of claim 1 further comprising a third connecting portion extending from the strap ring and a third affixing member connected to the end of the third connecting portion.

10. The security strap of claim 1 wherein the first and second affixing members are configured to be connected together to form an affixing loop around the exterior of the bottle.

11. A security strap for a beverage dispensing device having a bottle and a spout disposed at the mouth of the bottle, the security strap comprising:

a strap band having an opening configured to capture a portion of the spout;

a plurality of connecting portions extending from the strap band, each connecting portion including an affixing member at an end thereof, the affixing members being configured to be connected together to form a fastening band around the exterior of the bottle, wherein at least one of the affixing members includes an adhesive for adhering to the exterior of the bottle.

12. The security strap of claim 11 wherein at least one of the affixing members includes a self-adhering surface.

13. The security strap of claim 11 where the security strap has a generally uniform thickness.

14. A method of securing a spout disposed at a mouth of a bottle to the bottle using a security strap which includes a strap ring having an opening configured to capture a portion of the spout, and a plurality of connecting portions extending from the strap ring, each connecting portion having an affixing member at an end thereof, the method comprising:

placing the strap ring around the spout to capture a portion of the spout with the opening; and adhering the affixing members to the exterior of the bottle to secure the strap ring around the spout against the mouth of the bottle to prevent displacement of the spout for dispensing.

15. The method of claim 14 wherein adhering the affixing members comprises adhering each affixing member to the exterior of the bottle.

16. The method of claim 14 wherein adhering the affixing members comprises providing a self-adhesive surface on at least one of the affixing members.

17. The method of claim 14 wherein adhering the affixing members comprises connecting the affixing members together to form an affixing loop surrounding the bottle.

18. The method of claim 14 wherein adhering the affixing members comprises applying an adhesive between at least one of the affixing members and the exterior of the bottle.

19. The method of claim 14 wherein placing the strap ring around the spout comprises placing the strap ring around a proximal shoulder of the spout by passing a distal portion of the spout through the opening of the strap ring, the opening being larger than the distal portion of the spout and smaller than the proximal shoulder of the spout.

20. The method of claim 14 further comprising providing the security strap with at least one self-adhering surface releasably adhered to a strip, and peeling the security strap from the strip.

* * * * *